United States Patent [19]

Thornton

[11] 4,330,060

[45] May 18, 1982

[54] CAKE PLATE WITH MESSAGE CONCEALING COMPARTMENT

[76] Inventor: Craig E. Thornton, 19662 Sacramento, Huntington Beach, Calif. 92647

[21] Appl. No.: 140,132

[22] Filed: Apr. 14, 1980

[51] Int. Cl.[3] ..... B65D 65/16

[52] U.S. Cl. ..... 206/459; 206/45.31

[58] Field of Search ..... 206/216, 459, 371, 45.31, 206/45.32

[56] References Cited

U.S. PATENT DOCUMENTS

| | | | |
|---|---|---|---|
| 1,771,589 | 7/1930 | Strauss | 248/346 |
| 1,781,752 | 11/1930 | Fisher | 428/7 |
| 1,860,586 | 5/1932 | McIlhenney | 206/45.31 |
| 1,982,723 | 12/1934 | Bantleon et al. | 240/10 |
| 2,861,367 | 11/1958 | Chanslor | 40/70 |
| 3,442,438 | 5/1969 | Marban | 206/459 X |
| 3,514,887 | 6/1970 | Jacob | 40/324 |

*Primary Examiner*—Steven M. Pollard
*Attorney, Agent, or Firm*—Knobbe, Martens

[57] ABSTRACT

A food serving plate for receiving and mounting cakes, pastries, and the like, is provided with a hidden, internal compartment having an opening on one side of the cake plate. A card having a message area is selectively inserted completely within the compartment through its opening to conceal the message or partially removed from the compartment to display the message. The message can be coordinated with the message decorated on the cake mounted on the cake plate and displayed at the time the cake is presented to its recipient. The card is also provided with a small tab to permit the manual removal of the card when the message area is concealed within the compartment and further provided with a slot which acts in conjunction with a leg on the cake plate to prevent the complete removal of the card from the compartment.

11 Claims, 4 Drawing Figures

Fig. 1
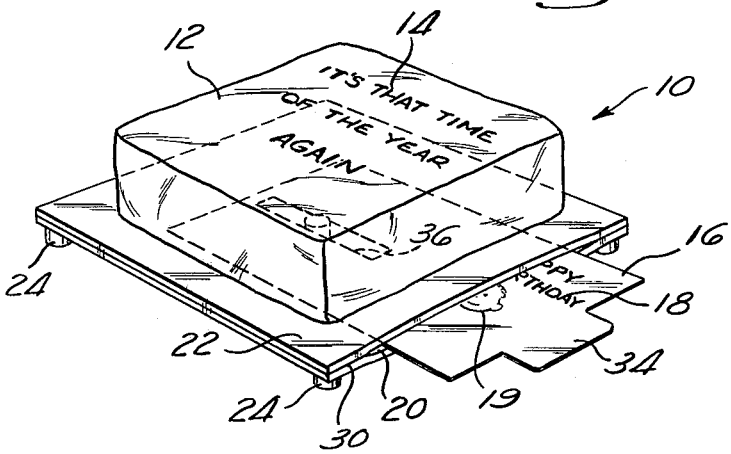
Fig. 2
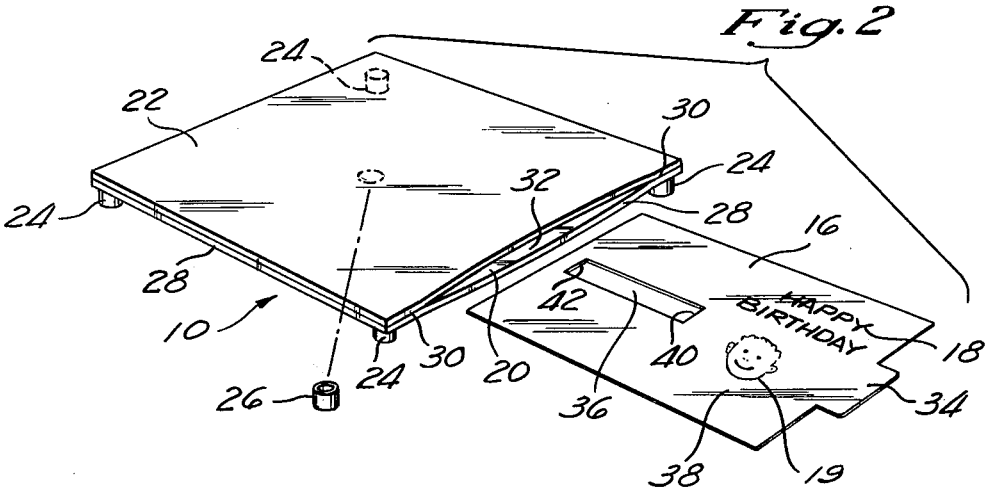
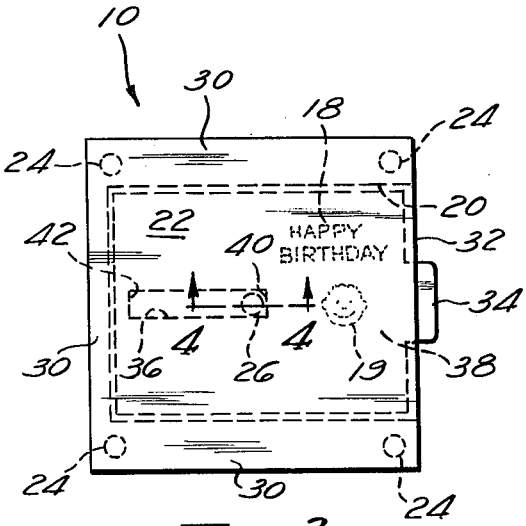
Fig. 3
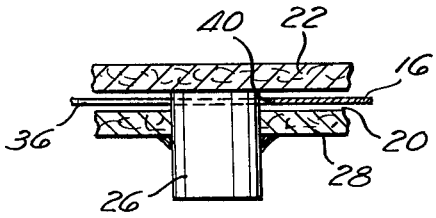
Fig. 4

CAKE PLATE WITH MESSAGE CONCEALING COMPARTMENT

BACKGROUND OF THE INVENTION

It has long been a favorite tradition to present a cake as a gift at certain special occasions, such as weddings, birthdays, anniversaries, etc. Typically, the cake is festively decorated with a message and/or illustration, such as "Happy Birthday", which is appropriate for the particular event or occasion being celebrated. Heretofore, however, the extent of the written message and the sophistication of the illustration decorated on the cake has been limited both by the space limitations of the top surface of the cake and by the relative difficulty associated with creating such decorations with icing. As a result, the messages communicated to the recipient of the cake generally tend to be short in length and very simply worded. Furthermore, illustrations which may be decorated on the cake typically are either extremely simple or require professional decoration, giving rise to a much greater expense.

Therefore, there is a complete lack of a simple, yet inexpensive means for communicating more than just a short message, or simple illustration to the recipient on a cake on special occasions.

SUMMARY OF THE INVENTION

The present invention relates to a cake plate which is provided with a displayable message card that can be imprinted with a written message or illustration. This message card is compactly concealed within a hidden compartment located beneath the cake plate and can be partially, slidably withdrawn from the compartment, either upon presentation of the cake or at another appropriate time, to reveal the message. The message may be in addition to or coordinated with a message decorated on the cake.

The cake plate of the present invention is comprised of a square, planar plate, which mounts the cake, and four small supporting legs located generally in the four corners of the plate. A compartment or envelope is integrally formed on the underside of the plate by attaching a sheet of material to the plate and sealing it to the plate along three of its edges. The fourth edge is not sealed and therefore forms an opening at one end of the compartment, which is hidden beneath the plate, to provide external accessibility to the compartment.

A message card is slidably inserted into the compartment through its opening. The width of the card is just slightly less than that of the compartment so that the sliding movement of the card is guided by the longitudinal edges of the compartment. Furthermore, the length of the message card is such that it can be completely concealed within the compartment, except for a small tab located at one end of the message card. When the card is completely inserted within the compartment, the tab extends through the opening to permit the card to be manually withdrawn.

Located at the opposite end of the message card is a longitudinal slot which receives a fifth, centrally located support leg. This leg is rigidly installed on the bottom of cake plate and extends through the sheet which forms the compartment with the plate, through the longitudinal slot in the message card, and into the plate itself. Thus, the slot in the message card rides on this central leg, assisting the longitudinal edges of the compartment itself in guiding the movement of the message card as it slides into and out of the compartment. In addition, the longitudinal distance through which the message card can be moved is defined by the length of this slot; thus, the abutment of the ends of the slot against this fifth leg prevents the message card from being removed or inserted too far, thereby avoiding, in the latter case, possible damage to the compartment or to the card.

Located on the message card generally between the slot and the small tab is a message area on which a written message or illustration can be printed. When the message card is entirely inserted within the compartment, this message area is concealed; however, when the card is pulled out through the opening by means of the tab, this message area becomes visible. The message contained on this area can be any written message or illustration which is appropriate for the occasion being celebrated.

For example, the message may comprise the punch line of an anecdote, the initial lines of which are decorated on the cake. Alternatively, the message or illustration on the message card may be in lieu of any message upon the cake itself, thereby eliminating the difficulty and expense associated with decorating it upon the cake. Furthermore, the cake plate of the present invention permits a message to be displayed with the presentation of a dessert item other than a cake or with other food items which generally do not permit the decoration to include a message.

Thus the cake plate of the present invention provides message and illustration capacity in connection with the presentation of a cake or other desert item in the celebration of a special event or occasion. These messages are contained on a message card which is compactly and efficiently incorporated into the cake plate itself and can be selectively concealed beneath the cake plate or visually displayed. Because the message card can remain concealed until an opportune moment, the surprise and curiosity of the occassion are heightened, thereby enhancing the pleasing effect of the presentation of the cake and the enjoyment of the celebration in general. Furthermore, such messages or illustrations can be simply and inexpensively created on the message card, either privately or commercially, because such printing is not limited to the medium of decorative cake icing.

DESCRIPTION OF THE DRAWINGS

FIG. 1 is a perspective view of the cake plate of the present invention illustrating the message card in a partially removed position from its concealed position;

FIG. 2 is another perspective view of the present cake plate, partially exploded, illustrating the message card of the present invention withdrawn from its concealed position and the location of the central support leg;

FIG. 3 is a top plan view of the cake plate showing the concealed location of the message card within the compartment of the cake plate; and FIG. 4 is a partial cross-sectional view taken along lines 4—4 of FIG. 3, illustrating the relationship between the slot in the message card and the central support leg.

DETAILED DESCRIPTION OF THE INVENTION

Referring to FIG. 1, there is shown the pastry plate 10 of the present invention mounting a cake 12 with a message 14 decorated onto its top surface. A normally concealed message card 16 bearing a written message 18 is shown partially removed from its compartment 20. This compartment is located beneath the top surface 22 of the cake plate 10. The message 18 on the message card 16 can correspond to the message 14 decorated on the cake 12 or may be separate and apart from that message. Alternatively, there may be no message decorated on the cake 12, with the only message displayed to the recipient of the cake being that located on the message card 16. Although the plate 10 is generally referred to herein as a cake plate, plates constructed in accordance with this invention are very useful for serving other food items since they permit, for example, a message or illustration to be displayed in conjunction with the presentation of other dessert items which may be difficult or impractical to decorate with a message.

The construction of the present invention can be explained with reference to FIGS. 2, 3 and 4. Referring initially to FIG. 2, the cake plate 10 is shown with the message card 16 completely removed from the compartment 20. The cake plate 10 is advantageously comprised of a substantially square, top planar surface 22 which is supported by four short legs 24, one located approximately in each of the four corners of the cake plate 10, and by a fifth leg 26, (shown in exploded position in FIG. 2) centrally located beneath the cake plate 10. When the plate is intended to be disposible, the top surface 22 of the cake plate is preferably made from a double thick, corrugated cardboard material. Similarly, the five support legs 24 and 26 are also preferably made from a cardboard material. However, all of these elements can also be constructed from other suitable materials, such as plastic, metal, etc. which are sufficiently rigid to support a cake or dessert item and also durable to permit the plate to be reused.

A second sheet of material 28, which preferably is made of paper or thin cardboard, having approximately the same dimensions as the top surface 22 of the cake plate 10, is attached to the underside of the top surface 22, as shown in FIG. 2. This sheet 28 is sealed to the top surface 22 along three of its edges to form sealed portions 30, two of which are illustrated in FIG. 2. The sheet 28 can be sealed to the top surface 22 by an adhesive or other suitable means, thereby forming an integral envelope or hidden compartment 20 beneath the top surface 22 of the cake plate 10. The fourth edge of this sheet 28 is not sealed to the top surface to provide an opening 32 to the compartment 20.

Referring again to FIG. 2, the message card 16 is also preferably constructed from a thin cardboard material, permitting a message 18 or illustration 19 to be easily imprinted thereon and further providing some rigidity to the message card 16 to enhance its durability. The message card 16 is essentially rectangular in shape, except for a small tab 34 located at one end of the card 16. This tab 34 provides easy accessibility to the message card 16 when it is completely inserted within the compartment 20 and facilitates its removal therefrom.

At the opposite end of the card 16, there is located a longitudinal, rectangular slot 36. As will be explained in more detail below, this slot 36 cooperates with the central support leg 26 of the cake plate 10 to control the sliding movement of the message card 16 into and out of the compartment 20. A large message area 38 is located on the message card 16 between the tab 34 and the slot 36. This message area 38, which is visible when the message card 16 is removed from the compartment 20, can be imprinted with any written message 18 or illustration 19, as shown in FIG. 2. The message 18 can be applied directly to the message card 16 or printed on another medium (not shown) and then attached to the message card. In the latter case, the reusability of the present cake plate is facilitated by simply removing the attached message and replacing it with another one.

FIGS. 3 and 4 illustrate the working relationship between the message card 16 and the cake plate 10 of the present invention. As shown in the top plan view of FIG. 3, when the message card 16 is completely inserted within the compartment 20, the message 18 on the card is concealed. Only the tab 34, which extends out of the compartment 20 through the opening 32, is visible, thereby permitting manual withdrawal of the card 16 from the compartment 20. The width of the message card 16 is just slightly less than the width of the compartment 20; therefore, the longitudinal sides of the compartment 20 serve to guide the card 16 as it slides in and out of the compartment 20.

As clearly shown in FIG. 3, the four support legs 24 which are located in the corners of the cake plate 10 do not obstruct the compartment 20 since they are attached to the cake plate 10 along the three sealed portions 30. As shown in FIG. 4, however, the fifth, centrally located support leg 26 extends through the lower sheet 24, into the compartment 20, through the longitudinal slot 36 in the message card 16 and is rigidly attached to the bottom of the top surface 22 of the cake plate 10 by an adhesive or other suitable means. Thus, as the message card 16 slides into and out of the compartment 10, its movement is limited by the movement of the slot 36 along this central support leg 26. Therefore, when the message card 16 is inserted completely into the compartment, as shown in FIG. 3, the right end 40 of the slot 36 abuts against the central support leg 26 and prevents the card from being further inserted into the compartment, thereby preventing possible damage to the card 16 and to the compartment 20. When the card 16 is withdrawn from the compartment 20, the abutment of the left end 42 of the slot 36 against the central support leg 26 prevents the card 16 from being completely removed from the compartment 20 and the cake plate.

FIG. 3 illustrates that the length of the slot 26 is approximately equal to the width of the message area 38 on the message card 16. Therefore, when the message card 16 is withdrawn from the compartment 20 to its maximum extent, only the message area 38 is visible. When the cake 12 is presented on the cake plate 10 of the present invention, it is preferable that the message card 16 be inserted completely within the compartment 20, as shown in FIG. 3. Then, at the appropriate moment, the card 16 can be withdrawn from the compartment 20 by means of the tab 34 in order to display the message 18 or illustration 19 on the message area 38 of the card.

In conclusion, the cake plate of the present invention provides a novel device for communicating a message to the recipient of the cake, pastry or other dessert item which is presented in the celebration of a special occasion. Furthermore, the present invention can advantageously be used to surprise the celebrant with a small gift, in addition to the cake, by attaching such gift to the message area 38 on the message card 16. For example, money, a personal check or other negotiable instrument (not shown) could be easily attached to the card and presented with or in lieu of the message 18 or illustration 19.

What is claimed is:

1. A food serving plate for mounting cakes, dessert items, and the like, comprising:

a planar plate for receiving and mounting said cakes, dessert items, and the like, said plate having a hidden compartment with an opening at one side of said plate;

a normally concealed card, movable in said compartment, said card having a message portion for the display of a visual message, said message portion being selectively (i) exposed by partial removal of said card from said compartment through said opening or (ii) concealed by insertion of said card into said compartment through said opening; and means for preventing the complete removal of said card from said compartment, comprising:

a slotted opening in said card; and a peg fixed in said compartment and inserted through said slotted opening in said card such that the rear edge of said slotted opening abuts against said peg to prevent complete removal of said card from said compartment.

2. The cake plate of claim 1 wherein said hidden compartment is integral with and internally located within said plate.

3. The cake plate of claim 1 further comprising means for obtaining external access to said card when said card is concealed within said compartment.

4. The cake plate of claim 3 wherein said means for obtaining external access comprises a small tab on said card extending through said opening when said card is concealed within said compartment.

5. The cake plate of claim 1 wherein the width of said card is only slightly less than the width of said compartment so that the longitudinal edges of said compartment serve to guide said card during said selective removal or insertion of said card from said compartment through said opening.

6. The cake plate of claim 1 wherein said peg comprises a leg which, in conjunction with other, plural legs, is mounted on the underside of said cake plate to support said plate.

7. The cake plate of claim 1 wherein said hidden compartment is located underneath said plate.

8. The cake plate of claim 1 wherein said visual message contained on said message portion of said card is coordinated with a message decorated onto said cake, dessert item or the like mounted on said cake plate.

9. A cake plate for cakes, dessert items and the like, comprising:

a plate for mounting said cakes, dessert items and the like;

a sheet attached to the underside of said plate to form an internal, hidden compartment underneath said plate, said compartment having an opening on one side of said plate;

plural legs attached to the underside of said plate to support said plate, at least one of said legs extending through said sheet and said internal compartment for an attachment to said plate;

a message card slidably inserted into said compartment, comprising:

a message area on said card bearing a written and/or visual message coordinated with a message decorated onto said cake, dessert item, and the like mounted on said plate, said message area being selectively displayed by partially slidably removing said card from said compartment through said opening or being concealed by slidably inserting said card completely within said compartment;

a tab on said card extending through said opening when said card is completely inserted within said compartment to provide manual accessibility to said card; and a slot in said card adapted to surround said one leg so that upon said partial removal of said card from said compartment, one edge of said slot abuts said one leg to prevent the complete removal of said card from said compartment, said slot and said one leg further providing guidance to said card during movement of said card in said compartment.

10. A food serving plate for mounting cakes, dessert items, and the like, comprising:

a planar plate for receiving and mounting said cakes, dessert items and the like, said plate having a hidden compartment with an opening at one side of said plate;

a normally concealed card movable in said compartment, said card having a message portion for the display of a visual message, said message portion being selectively (i) exposed by partial removal of said card from said compartment through said opening or (ii) concealed by insertion of said card into said compartment through said opening;

means for preventing the complete removal of said card from said compartment, said preventing means comprising a slotted opening in said card, and a peg fixed in said compartment and inserted through said slotted opening in said card such that the rear edge of said slotted opening abuts against said peg to prevent complete removal of said card from said compartment.

11. The cake plate of claim 10 wherein said peg comprises a leg which, in conjunction with other, plural legs, is mounted on the underside of said cake plate to support said plate.

* * * * *